US011035648B2

(12) United States Patent
Zhang

(10) Patent No.: US 11,035,648 B2
(45) Date of Patent: Jun. 15, 2021

(54) QUICK-RELEASE ADAPTER

(71) Applicant: Cytac Technology Limited, Shenzhen (CN)

(72) Inventor: Yong Zhang, Shenzhen (CN)

( * ) Notice: Subject to any disclaimer, the term of this patent is extended or adjusted under 35 U.S.C. 154(b) by 0 days.

(21) Appl. No.: 16/841,712

(22) Filed: Apr. 7, 2020

(65) Prior Publication Data

US 2020/0232757 A1 Jul. 23, 2020

(30) Foreign Application Priority Data

Jun. 11, 2019 (CN) ..... 201920875913.6

(51) Int. Cl.
*F41C 33/02* (2006.01)
*F41C 33/04* (2006.01)

(52) U.S. Cl.
CPC ..... *F41C 33/0272* (2013.01); *F41C 33/0263* (2013.01); *F41C 33/0227* (2013.01); *F41C 33/041* (2013.01); *F41C 33/045* (2013.01)

(58) Field of Classification Search
CPC ..... F41C 33/0272; F41C 33/0263; F41C 33/0227; F41C 33/041; F41C 33/045; A45F 2005/025; A45F 2005/026; A45F 2005/027
USPC ..... 224/198, 197, 199, 200
See application file for complete search history.

(56) References Cited

U.S. PATENT DOCUMENTS 5,419,472 A * 5/1995 Hellweg ..... A45F 5/02 224/193
10,458,749 B1 * 10/2019 Zhang ..... F41C 33/041
2007/0278266 A1 * 12/2007 Parsons ..... F41C 33/045 224/197
2011/0174847 A1 * 7/2011 Crye ..... F41C 33/0236 224/243
2013/0284772 A1 * 10/2013 Paugh ..... A45F 5/004 224/162
2015/0157118 A1 * 6/2015 Tseng ..... F41C 33/041 403/322.4
2015/0323285 A1 * 11/2015 McKendrick ..... F41C 33/045 224/192
2018/0195834 A1 * 7/2018 Tedder ..... B60R 7/14
2019/0219359 A1 * 7/2019 Rogers ..... F41C 33/045

* cited by examiner

*Primary Examiner* — Corey N Skurdal
(74) *Attorney, Agent, or Firm* — HYIP

(57) ABSTRACT

The present disclosure provides a quick-release adapter. The quick-release adapter comprises a regulating part, a fixing part, and a functional part. The regulating part is engaged with or detached and separated from the fixing part through a chute. The fixing part is equipped with the U-shaped chute located in three sides of a chute surface of the fixing part to form a U-shaped structure. The regulating part slides into the fixing part along, the chute to form an engaged quick-release part. The functional part is fixed to a functional mounting surface, of the regulating part through a rotating mechanism. The functional part rotates around the rotating mechanism. Furthermore, the rotating mechanism comprises rotation holes, a regulating rod, a rotation fixing disc and a rotation limiting disc.

13 Claims, 7 Drawing Sheets

QUICK-RELEASE ADAPTER

TECHNICAL FIELD

The present disclosure relates to the technical field of security equipment, and in particular to a quick-release adapter.

BACKGROUND

An important law enforcement manner of the policeman and other security personnel is to wear a gun, so it is very important to place the gun. The modern holster basically should be convenient to carry, not affect the action of the user, and be simply, conveniently and quickly putted on and off.

The holster mostly designs a mounting guide rail for holster accessories. Using a connector of the guide rail for the holster accessories, the gun can be easily putted in and taken out of the holster along the guide rail. However, the existing holster generally is common leather or polystyrene and is designed too simply so as to only protect the gun, but not protect a switch of the gun, and when putting on the holster, the user cannot randomly move. When a user puts on a holster with a gun, such holster may affect the action of the user. Moreover, as the holster is a functional part, the user cannot take out and put in the gun by any angles unless following the guide rail of the holster, which is inconvenient to use. Moreover, the user needs to load the gun by double hands after taking out the gun, which is not beneficial to quick use.

Therefore, it is an emergent technical problem how to provide a functional part mounting device which can be conveniently and quickly mounted and detached and has high stability and safety in the prior art.

SUMMARY

An objective of the present disclosure is to provide a quick-release adapter to solve the technical problem that it is lack of a functional part mounting device which can be conveniently and quickly mounted and detached and has high stability and safety in the prior art.

To achieve the objective above, the present disclosure provides a quick-release adapter, comprising a quick-release part and a functional part.

The quick-release part comprises a fixing part and a regulating part. The regulating part is engaged with or detached and separated from the fixing part through a chute.

The U-shaped chute is formed in the fixing part and located in three sides of a chute surface of the fixing part to form a U-shaped structure.

The regulating part slides into the fixing part along the chute to form an engaged quick-release part.

The functional part is fixed to a functional mounting surface of the regulating part through a rotating mechanism. The functional part rotates around the rotating mechanism. Further, the rotating mechanism comprises rotation holes, a regulating rod, a rotation, fixing disc and a rotation limiting disc. The regulating rod passes through the rotation holes of the regulating part and the functional part to fasten the regulating part and the functional part. The functional part is limited through the matching of the rotation limiting disc on the functional part and the rotation fixing disc on the regulating part.

Optionally, the rotation fixing disc and the rotation limiting disc are gears with protruded teeth. A groove is arranged between every two adjacent protruded teeth. The groove and the protruded teeth are matched with each other. After the regulating rod is loosened, the protruded teeth of the rotation limiting disc are loosened from the grooves of the rotation fixing disc to regulate the position of the rotation limiting disc.

Optionally, the rotation fixing disc is equipped with at least two limiting holes in, the periphery of the rotation hole. The rotation limiting disc is equipped with limiting bulges at positions corresponding to the limiting holes. The limiting bulges match with the limiting holes. Loosening the regulating rod, the limiting bulges of the rotation limiting disc are loosened from the limiting holes of the rotation fixing disc to regulate the position of the rotation limiting disc.

Optionally, an arc rotation slot is formed in the rotating mechanism on the regulating part. The functional part is engaged in the arc rotation slot.

Optionally, a rotation control button and a rotation control rod are arranged on the rotating mechanism on the regulating part. The rotation control rod is connected with the rotating mechanism on the regulating part to drive a rotary plate to rotate. The rotation control button is connected with the rotation control rod and controls the rotation control rod to move or stop.

Optionally, the quick-release adapter further comprises a supporting part. The supporting part comprises a quick-release part supporting surface and a quick-release part limiting protruded disc. The quick-release part limiting protruded disc and the quick-release part supporting surface form a step structure. The quick-release part limiting protruded disc is attached with the fixing part to fix the fixing part to the supporting part.

Optionally, the fixing part comprises a latching groove located in one side of the U-shaped structure.

The regulating part comprises a latch. The latch is located at a position, corresponding to the latching groove, of a side of the regulating part.

Optionally, the latch is elastic and has a slope towards a bottom side of a U-shaped groove. After the latch slides into the latching groove, a latching side face of the latch relative to the slope is engaged with the latching groove. After the latch is pressed down, the latching side face slides out of the latching groove such that the engagement of the fixing part and the regulating part is released.

The quick-release adapter of the present disclosure achieves the following beneficial effects:

(1) According to the quick-release adapter of the present disclosure, the fixing part is engaged with and detached from the regulating part through the chute such that the functional part fixed to the regulating part can be quickly and stably mounted at the fixing part to achieve quick mounting and detachment of the functional part. The fixing part and the regulating part can be detached and assembled to achieve a random replacement function of different functional parts on a wearable belt and to improve the mounting and carrying flexibility of the functional part.

(2) According to the quick-release adapter of the present disclosure, the functional part is detachably mounted at a fixing part of the supporting part through the supporting part and the quick-release part. The functional part can be quickly and safely mounted and detached through the quick-release part. A user can mount and detach the functional part by multiple angles. Therefore, the user can conveniently use the functional part, and the safety and the stability of the functional part during mounting and detaching are improved.

BRIEF DESCRIPTION OF THE DRAWINGS

To describe the technical solutions in the embodiments of the present disclosure or in the prior art more clearly, the following briefly describes the accompanying drawings required for describing the embodiments or the prior art. Apparently, the accompanying drawings in the following description show some embodiments of the present disclosure, and persons skilled in the art may still derive other drawings from these accompanying drawings.

DESCRIPTION OF THE EMBODIMENTS

The technical solutions of the embodiments of the present application are clearly and completely described below with reference to the accompanying drawings of the embodiments of the present application. Apparently, the described embodiments are some rather than all of the embodiments of the present application. All other embodiments obtained by persons skilled in the art based on the embodiments of the present disclosure without creative efforts shall fall within the protection scope of the present disclosure.

Embodiment 1

Figure 1:
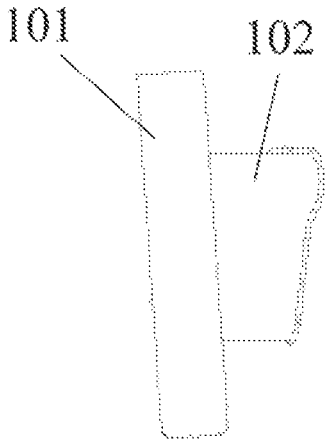
FIG. 1 is a schematic structural diagram of a quick-release adapter in an embodiment of the present disclosure.
Figure 2:
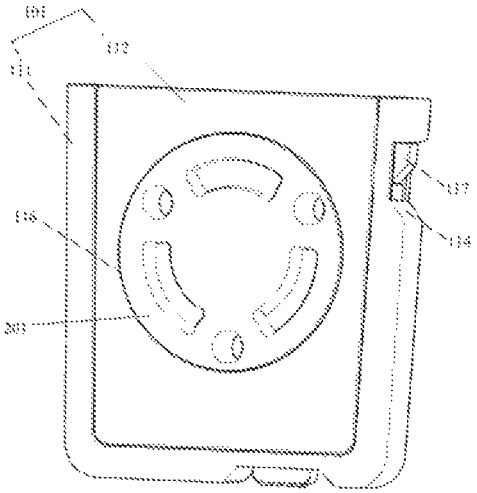
FIG. 2 is a schematic structural diagram of a quick-release part of a quick-release adapter in an embodiment of the present disclosure.
Figure 3:
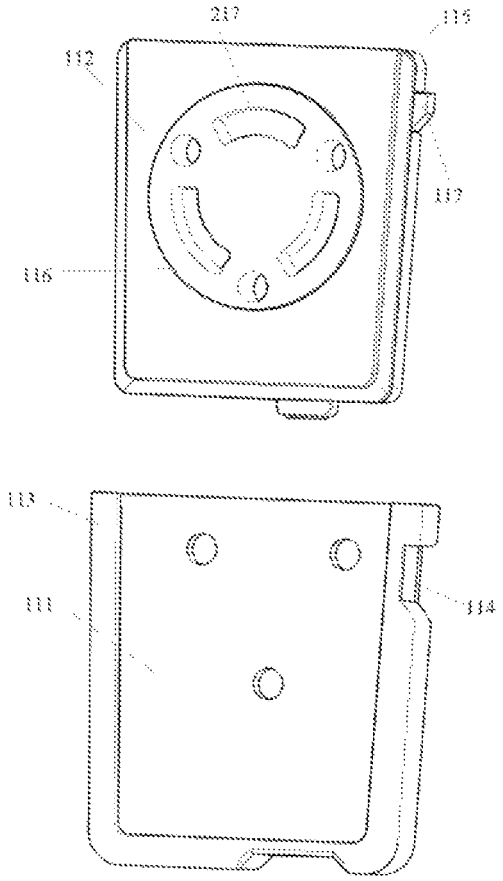
FIG. 3 is a schematic diagram showing a separated structure of a quick-release part of a quick-release adapter in an embodiment of the present disclosure.
Figure 4:
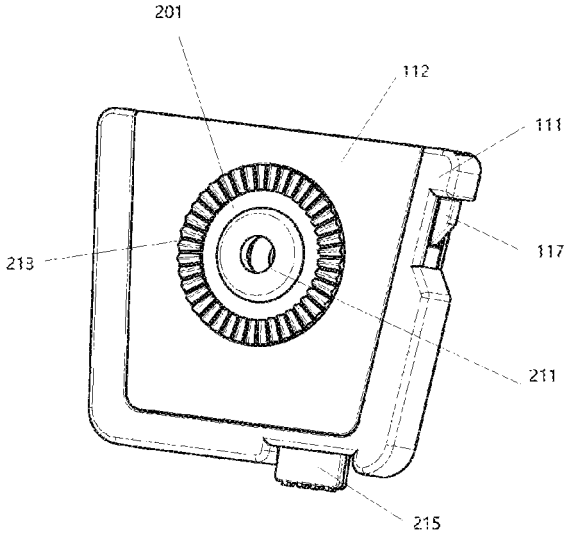
FIG. 4 is a schematic diagram showing an internal structure of a regulating part of a quick-release adapter in an embodiment of the present disclosure.
Figure 5:
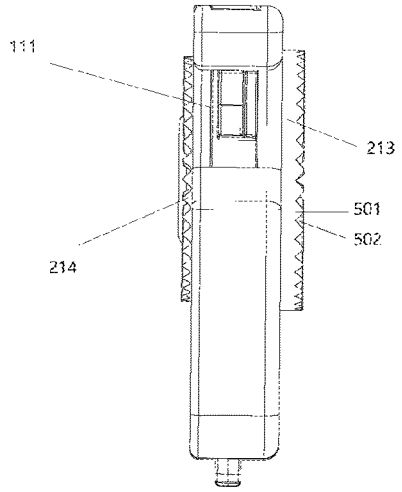
FIG. 5 is a schematic diagram showing a side structure of a regulating part of a quick-release adapter in an embodiment of the present disclosure.

As shown in FIG. 1 to FIG. 5, FIG. 1 is a schematic structural diagram of a quick-release adapter in an embodiment; FIG. 2 is a schematic structural diagram of a quick-release part of a quick-release adapter in an embodiment; FIG. 3 is a schematic diagram showing a separated structure of a quick-release part of a quick-release adapter in an embodiment; FIG. 4 is a schematic diagram showing a structure of a regulating part of a quick-release adapter in an embodiment; FIG. 5 is a schematic diagram showing a side structure of a regulating part of a quick-release adapter in an embodiment. A quick-release adapter comprises a quick-release part 101 and a functional part 102.

The quick-release part 101 comprises a fixing part 111 and a regulating part 112. The regulating part 112 is engaged with or detached and separated from the fixing part 111 through a chute 113.

The fixing part 111 comprises the chute 113 and a latching groove 114. The chute 113 is U-shaped and located in three sides of a chute surface of the fixing part to form a U-shaped structure. The U-shaped structure comprises side slots in two sides and a bottom side slot in a bottom side. The latching groove 114 is located in one side of the U-shaped structure and is used for matching with a latch of the regulating part to limit the regulating part to the interior of the fixing part so as to prevent the regulating part from dropping off.

The regulating part 112 comprises a fixing part attaching surface 115, a functional part mounting surface 116 and a latch 117. The functional part mounting surface 116 and the fixing part attaching surface 115 are arranged back to back. The latch 117 is located in a position, corresponding to the latching groove, of a side of the regulating part. The regulating part slides into the fixing part along the chute to form an engaged quick-release part. The regulating part slides out of the fixing part along the chute to achieve detachment of the quick-release part.

The functional part 102 is fixed to the functional mounting surface 116 of the regulating part through a rotating mechanism. The functional part rotates around the rotating mechanism. Optionally, the functional part, may be a holster or accessories fitting for the quick-release part, such as a flashlight pouch, a truncheon pouch, a handcuff pouch, an expandable baton pouch, a pepper spray pouch and the like.

The regulating part of the quick-release part slides into the chute of the fixing part to achieve its quick wearing function, meanwhile, the latch is engaged in the latching groove of the chute such that the regulating part cannot easily slide away the fixing part. When the regulating part needs to be detached from the functional part, the regulating part can be pulled out after the latch is pressed down so as to achieve a quick release function of the regulating part attaching with the functional part.

Figure 7:
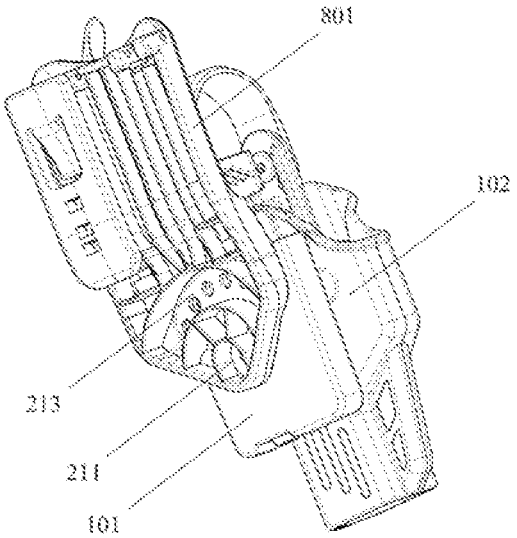
FIG. 7 is a schematic structural diagram of an optional quick-release adapter in an embodiment of the present disclosure.
Figure 8:
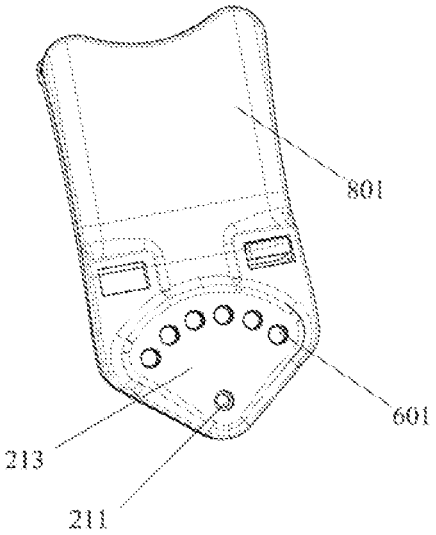
FIG. 8 is a schematic structural diagram of a supporting part of an optional quick-release adapter in an embodiment of the present disclosure.
Figure 9:
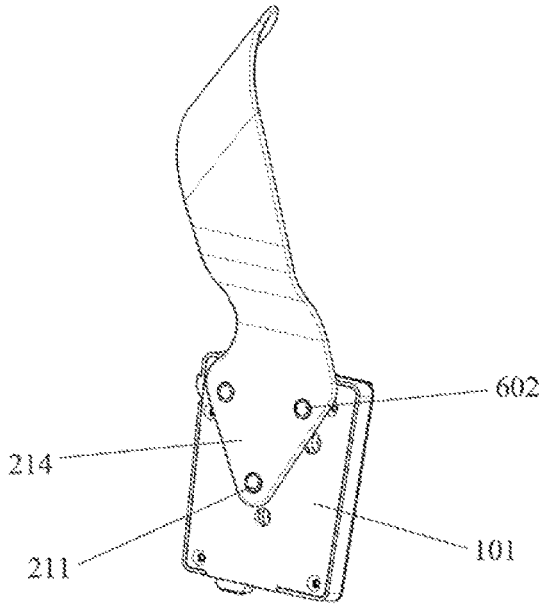
FIG. 9 is a schematic structural diagram of a quick-release part of an optional quick-release adapter in an embodiment of the present disclosure.

The rotating mechanism 201 comprises rotation holes 211, a regulating rod, a rotation fixing disc 213 and a rotation limiting disc 214. The regulating rod passes through the rotation holes 211 of the regulating part and the functional part to fasten the regulating part and the functional part. The regulating rod may be a thumbscrew which can limit the functional part through the matching of the rotation limiting disc on the functional part and the rotation fixing disc on the regulating part by regulating the fastening degree of the regulating part and the functional part to cause that the functional part cannot rotate. After the regulating rod is loosened, the matching between rotation limiting disc on the functional part and the rotation fixing disc on the regulating part is, loosened such that the functional part can rotate. Optionally, as shown in FIG. 7 to FIG. 9, FIG. 7 is a schematic structural diagram of an optional quick-release adapter in an embodiment; FIG. 8 is a schematic structural diagram of a supporting part of an optional quick-release adapter in an embodiment; FIG. 9 is a schematic structural diagram of a quick-release part of an optional quick-release adapter in an embodiment. The quick-release adapter further comprises a supporting part 801 used for mounting the quick-release part 101. The, fixing part 111 of the quick-release part and the supporting part 801 may be connected by using the rotating mechanism 201 to achieve a rotation function of the quick-release part on the supporting part. In the matching of the rotation hole 211 in the supporting part 801, the rotation fixing disc 213. the rotation limiting disc 214 on the fixing part 111 and the regulating rod 212. the regulating rod (which may be the thumbscrew) passes through the rotation holes of the supporting part and the fixing part to fasten or loosen the fixing part and the supporting part. The regulating part and the functional part also adopt the same rotating mechanism.

In some optional embodiments, as shown in FIG. 1 to FIG. 4, the functional part 102 is connected with the regulating part 112 through the rotating mechanism 201 on the functional mounting surface. The functional part 102 rotates around the rotating mechanism 201.

In some optional embodiments, an arc rotation slot 217 is formed in the rotating mechanism 201 on the regulating part 112. The functional part 102 is engaged in the arc rotation slot 217.

Figure 6:
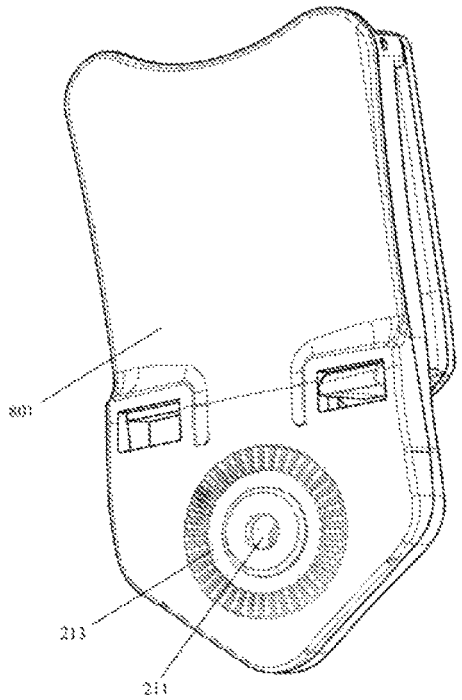
FIG. 6 is a schematic structural diagram of a rotation fixing disc of another quick-release adapter in an embodiment of the present disclosure.

In some optional embodiments, as shown in FIG. 4 to FIG. 6, FIG. 6 is a schematic structural diagram of a rotation fixing disc of another quick-release adapter in embodiments of the present disclosure. The rotation fixing disc 213 and the rotation limiting disc 214 are gears with protruded teeth 501. A groove 502 is arranged between every two adjacent protruded teeth. The groove and the protruded teeth are matched with each other. After the regulating rod is loosened, the protruded teeth of the rotation limiting disc are loosened from the grooves of the rotation fixing disc to regulate the position of the rotation limiting disc.

In some optional embodiments, as shown in FIG. 8 and FIG. 9, the rotation fixing disc 213 is equipped with at least two, limiting holes 601 in the periphery of the rotation hole. The rotation limiting disc 214 is equipped with limiting bulges 602 at positions corresponding to the limiting holes. The limiting bulges match with the limiting holes. Loosening the regulating rod, the limiting bulges of the rotation limiting disc are loosened from the limiting holes of the rotation fixing disc to regulate the position of the rotation limiting disc.

Figure 10:
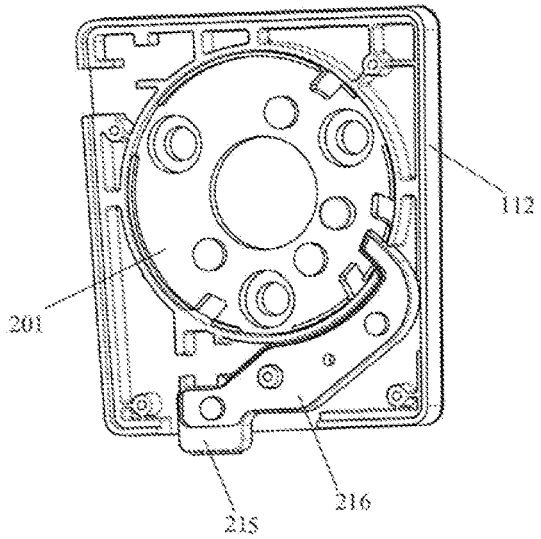
FIG. 10 is a schematic diagram showing an internal structure of a regulating part of a quick-release adapter in an embodiment of the present disclosure.
Figure 11:
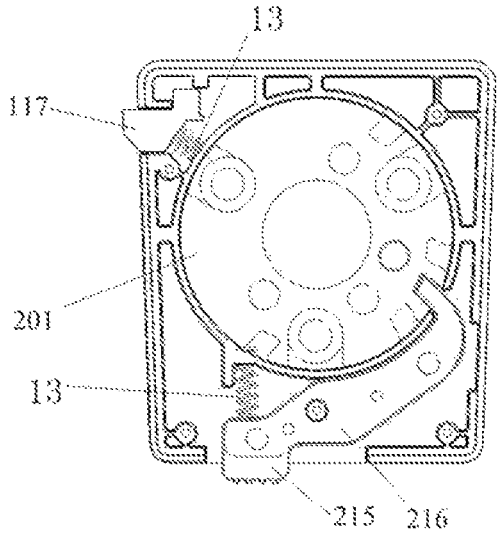
FIG. 11 is a schematic diagram showing another internal structure of a regulating part of a quick-release adapter in an embodiment of the present disclosure.

In some optional embodiments, as shown in FIG. 10 and FIG. 11, FIG. 10 is a schematic diagram showing an internal structure of a regulating part of a quick-release adapter in embodiments of the present disclosure. FIG. 11 is a schematic diagram showing another internal structure of a regulating part of a quick-release adapter in embodiments of the present disclosure. A rotation control button 215 and a rotation control rod 216 are arranged on the rotating mechanism 201 on the regulating part 102. The rotating mechanism on the regulating part is a rotary plate. The rotation control rod 216 is connected with the rotary plate to drive the rotary plate to rotate. The rotation control button 215 is connected with the rotation control rod and controls the rotation control rod to move or stop. Optionally, a main rotary gear is mounted at the center of the rotary plate, a plurality of shift grooves are circumferentially arranged in the main rotary gear, and the rotation control rod is provided with a shift hook matching with the shift grooves. Through the matching of the shift hook and the different shift grooves, the angle regulation of the holster can be achieved, and a proper angle of the functional part is to be regulated. Optionally, the latch 117 and the rotation control button 215 can be connected with the regulating part or the rotating mechanism through springs 13.

Figure 12:
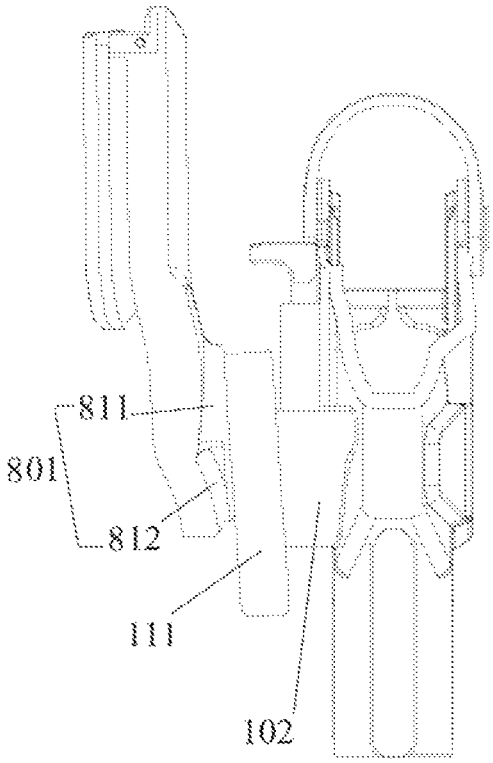
FIG. 12 is a schematic structural diagram of yet another quick-release adapter in an embodiment of the present disclosure.

In some optional embodiments, as shown in FIG. 12, FIG. 12 is a schematic structural diagram of yet another quick-release adapter in embodiments of the present disclosure. The quick-release adapter further comprises a supporting part 801. The supporting part comprises a quick-release part supporting surface 811 and a quick-release part limiting protruded disc 812. The quick-release part limiting protruded disc 812 and the quick-release part supporting surface 811 form a step structure. The quick-release part limiting protruded disc is attached with the fixing part to fix the fixing part to the supporting part. Optionally, the fixing part can be fixed to the supporting part through screws. The functional part can also be fixed to the main rotary gear of the regulating part through screws. The supporting part may be a waist protection plate which can be putted on the waist of a user such that the user can conveniently carry it.

Figure 13:
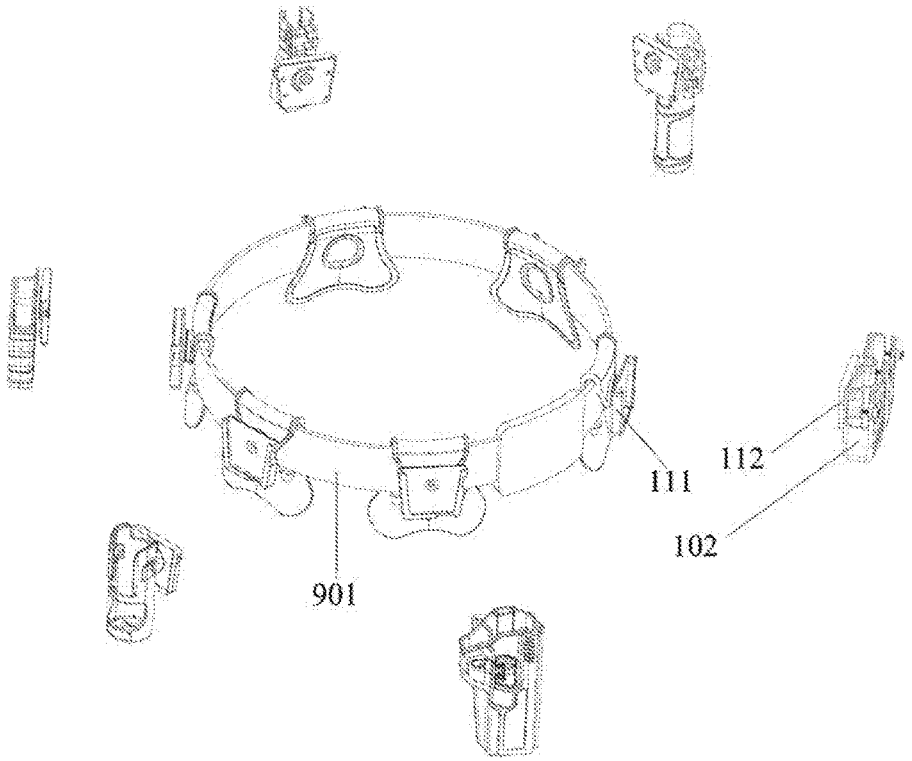
FIG. 13 is a schematic structural diagram when functional parts are detached from quick-release adapters on a wearable belt in an embodiment of the present disclosure.
Figure 14:
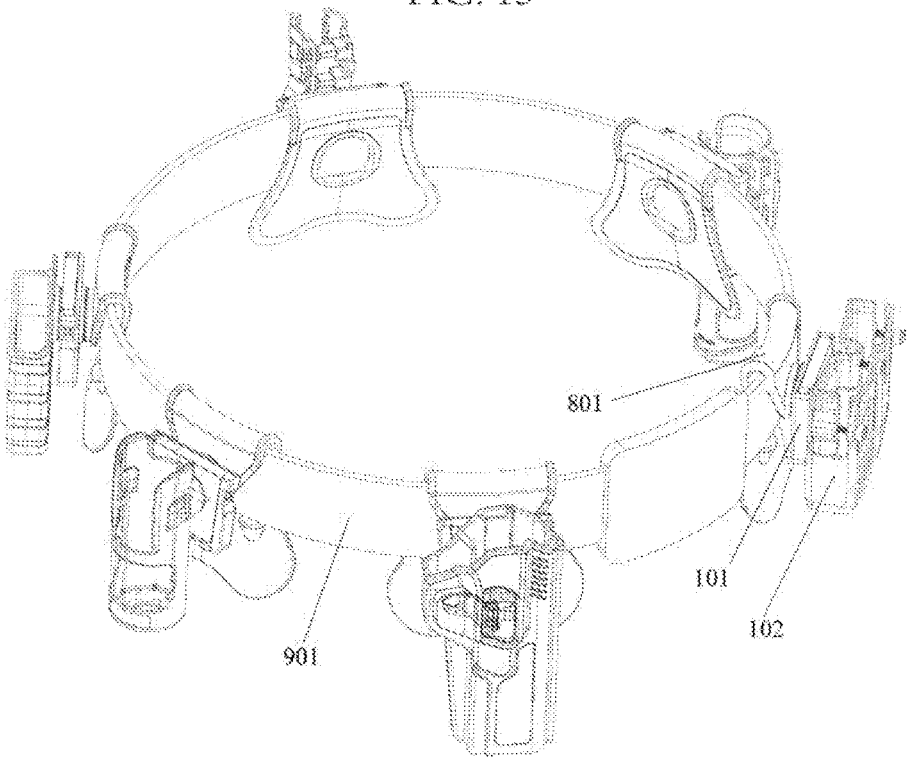
FIG. 14 is a schematic structural diagram when quick-release adapters are installed on a wearable belt in an embodiment of the present disclosure.

In some optional embodiments, as shown in FIG. 13 and FIG. 14, FIG. 13 is a schematic structural diagram when functional parts are detached from quick-release adapters on a wearable belt in embodiments of the present disclosure. FIG. 14 is a schematic structural diagram when quick-release adapters are mounted on a wearable belt in embodiments of the present disclosure. The multiple quick-release adapters are mounted on a wearable belt 901 through the supporting parts. The positions of the functional parts of the different quick-release adapters can further be exchanged without detaching the supporting parts and the fixing parts, thereby greatly improving the use convenience.

Although the preferred embodiments of the present disclosure have been described, persons skilled in the art can make additional changes and modifications to these embodiments once they learn the basic inventive concepts. Therefore, the appended claims are intended to be interpreted as including the preferred embodiments and all changes and modifications that fall within the scope of the present disclosure. Obviously, persons skilled in the art can make various modifications and variations to the present disclosure without departing from the spirit and scope of the present disclosure. In this way, if these modifications and variations of the present disclosure belong to the scope of the claims of the present disclosure and its equivalent technology, the present disclosure is intended to include these modifications and variations.

What is claimed is:

1. A quick-release adapter, comprising a quick-release part and a functional part, wherein the quick-release part comprises a fixing part and a regulating part; the regulating part is engaged with or detached and separated from the fixing part through a chute;

the U-shaped chute is formed in the fixing part and located in three sides of a chute surface of the fixing part to form a U-shaped structure;

the regulating part slides into the fixing part along the chute to form an engaged quick-release part;

the functional part is fixed to a functional mounting surface of the regulating part through a rotating mechanism; the functional part rotates around the rotating mechanism; further, the rotating mechanism comprises rotation holes, a regulating rod, a rotation fixing disc and a rotation limiting disc; the regulating rod passes through the rotation holes of the regulating part and the functional part to fasten the regulating part and the functional part; the functional part is limited through the matching of the rotation limiting disc on the functional part and the rotation fixing disc on the regulating part.

2. The quick-release adapter according to claim 1, wherein the rotation fixing disc and the rotation limiting disc are gears with protruded teeth; a groove is arranged between every two adjacent protruded teeth; the groove and the protruded teeth are matched with each other; after the regulating rod is loosened, the protruded teeth of the rotation limiting disc are loosened from the grooves of the rotation fixing disc to regulate the position of the rotation limiting disc.

3. The quick-release adapter according to claim 2, wherein the fixing part comprises a latching groove located in one side of the U-shaped structure;

the regulating part comprises a latch located at a position, corresponding to the latching groove, of a side of the regulating part.

4. The quick-release adapter according to claim 1, wherein the rotation fixing disc is equipped with at least two limiting holes in the periphery, of the rotation hole; the rotation limiting disc is equipped with limiting bulges at positions corresponding to the limiting holes; the limiting bulges match with the limiting holes; loosening the regulating rod, the limiting bulges of the rotation limiting disc are loosened from the limiting holes of the rotation fixing disc to regulate the position of the rotation limiting disc.

5. The quick-release adapter according to claim 4, wherein the fixing part comprises a latching groove located in one side of the U-shaped structure;

the regulating part comprises a latch located at a position, corresponding to the latching groove, of a side of the regulating part.

6. The quick-release adapter according to claim 1, wherein an arc rotation slot is formed in the rotating mechanism on the regulating part; the functional part is engaged in the arc rotation slot.

7. The quick-release adapter according to claim 6, wherein the fixing part comprises a latching groove located in one side of the U-shaped structure;

the regulating part comprises a latch located at a position, corresponding to the latching groove, of a side of the regulating part.

8. The quick-release adapter according to claim 1, wherein a rotation control button and a rotation control rod are arranged on the rotating mechanism on the regulating part; the rotation control rod is connected with the rotating mechanism on the regulating part to drive the rotating mechanism to rotate; the rotation control button is connected with the rotation control rod and controls the rotation control rod to move or stop.

9. The quick-release adapter according to claim 8, wherein the fixing part comprises a latching groove located in one side of the U-shaped structure;

the regulating part comprises a latch located at a position, corresponding to the latching groove, of a side of the regulating part.

10. The quick-release adapter according to claim 1, further comprising a supporting part, wherein the supporting part comprises a quick-release part supporting surface and a quick-release part limiting protruded disc; the quick-release part limiting protruded disc and the quick-release part supporting surface form a step structure; the quick-release part limiting protruded disc is attached with the fixing part to fix the fixing part to the supporting part.

11. The quick-release adapter according to claim 10, wherein the fixing part comprises a latching groove located in one side of the U-shaped structure;

the regulating part comprises a latch located at a position, corresponding to the latching groove, of a side of the regulating part.

12. The quick-release adapter according to claim 1, wherein the fixing part comprises a latching groove located in one side of the U-shaped structure;

the regulating part comprises a latch located at a position, corresponding to the latching groove, of a side of the regulating part.

13. The quick-release adapter according to claim 12, wherein the latch is elastic and has a slope towards a bottom side of a U-shaped groove; after the latch slides into the latching groove, a latching side face of the latch relative to the slope is engaged with the latching groove; after the latch is pressed down, the latching side face slides out of the latching groove such that the engagement of the fixing part and the regulating part is released.

* * * * *